US008757041B1

(12) United States Patent
Gillen

(10) Patent No.: US 8,757,041 B1
(45) Date of Patent: Jun. 24, 2014

(54) MULTI-LAYERED ANGULAR ARMOR SYSTEM

(76) Inventor: Steven D. Gillen, Fairfax, VA (US)

( * ) Notice: Subject to any disclaimer, the term of this patent is extended or adjusted under 35 U.S.C. 154(b) by 157 days.

(21) Appl. No.: 13/507,536

(22) Filed: Jul. 6, 2012

Related U.S. Application Data

(60) Provisional application No. 61/572,210, filed on Jul. 13, 2011.

(51) Int. Cl.
*F41H 1/02* (2006.01)
*F41H 5/00* (2006.01)
*F41H 5/04* (2006.01)

(52) U.S. Cl.
CPC ..... *F41H 5/0492* (2013.01); *F41H 1/02* (2013.01)
USPC ..... 89/36.02; 89/918; 2/2.5

(58) Field of Classification Search
CPC ..... F41H 5/0492; F41H 1/02
USPC ..... 89/36.01, 36.02, 36.12, 904, 901, 918, 89/921; 2/2.5; 428/911; 109/49.5; 114/9–12, 14
See application file for complete search history.

(56) References Cited

U.S. PATENT DOCUMENTS

| | | | | |
|---|---|---|---|---|
| 787,065 | A | 4/1905 | White | |
| 1,625,061 | A * | 4/1927 | Trout | 428/593 |
| 2,077,729 | A * | 4/1937 | Wilcox | 114/12 |
| 2,110,322 | A | 3/1938 | Calzavara | |
| 2,298,661 | A * | 10/1942 | Swanson | 114/11 |
| 2,316,055 | A | 4/1943 | Davey | |
| 2,393,350 | A * | 1/1946 | Wiedman | 109/49.5 |
| 4,433,522 | A | 2/1984 | Yerushalmi | |
| 4,905,320 | A * | 3/1990 | Squyers, Jr. | 2/22 |
| 4,965,138 | A | 10/1990 | Gonzalez | |
| 5,443,883 | A | 8/1995 | Park | |
| 6,170,378 | B1 | 1/2001 | Neal et al. | |
| 6,240,858 | B1 | 6/2001 | Mandall | |

* cited by examiner

*Primary Examiner* — Reginald Tillman, Jr.
(74) *Attorney, Agent, or Firm* — Neil F. Markva

(57) ABSTRACT

A tubular armor causes incoming projectiles to strike at a forty-five degree angle that induces vector alteration of the projectile upon impact. Its movement magnitude is reduced in force vector, momentum, and thus its kinetic energy. At least two facing layers of parallel tubes have a rectangular cross-section and are of a high ballistic material. The tubes are contiguously, fixedly disposed with respect to each other at outer opposed diagonal tube corners to form crests and valleys on opposed outer sides of each layer. The spaced layers have valleys of a front layer disposed over the crests of a back layer. Layer spacing is at an amount sufficient whereby when a projectile strikes the front layer facing a shooter, it compresses toward the back layer and transfers its kinetic energy laterally to follow a zig-zag path along the front layer.

20 Claims, 5 Drawing Sheets

MULTI-LAYERED ANGULAR ARMOR SYSTEM

RELATED APPLICATION

This is a non-provisional application for which priority is claimed in Provisional Application No. 61/572,210 filed Jul. 13, 2011.

BACKGROUND OF THE INVENTION

1. Field of the Invention

The present invention is in the field of armor systems used to protect against regular and armor piercing firearm projectiles and their fragments as well as debris of various objects (collectively referred to herein as projectiles). The invention provides an armor system suitable for a variety of purposes such as for making protective body garments, protective shields, and armored wall structures for enclosures including buildings, and vehicle and ship bodies. More particularly, the invention relates to personnel body garments having protective armor that incorporates principles applicable throughout the field of armor systems.

2. Background and Related Art Discussion

Armor plate adapted to be secured to the sides of war vessels has been known since the beginning of the $20^{th}$ century. U.S. Pat. No. 787,065 issued in 1905 discloses an armor plate of a simple, inexpensive multi-layered structure having a combined minimum weight with a maximum capacity to effectively protect war vessels by resisting against projectile penetration. The structure comprises superimposed plates of such character that a wall of armor plate can be of any desired thickness, and will tend to deflect projectiles from their course of travel.

U.S. Pat. No. 2,110,322 discloses a protective structure against artillery shells that has a plurality of rectangular elongated tubular structures formed by welding flat steel bars arranged side-by-side to form continuous layers as shown in FIG. 2. The tubular, rectangular cross-sections are welded at the apexes of each corner of the rectangular cross-sections.

U.S. Pat. No. 2,316,055 is directed to a shield made with alternative layers of flat and corrugated sheets. FIGS. 10 and 11 of U.S. Pat. No. 6,240,858 disclose the use of square cross-sectional tubing to produce a panel that is resistant to penetration by a projectile.

U.S. Pat. No. 5,443,883 shows a ballistic garment with panels 31 and 32 of non-woven ballistic laminate structures that contain multiple fiber bundles and substantially cover the wearer's thorax region to protect vital organs such as the heart and lungs. FIG. 7 shows a first panel 31 that has at least 10 and no more than 40 sheets of ballistic laminate structure 25 for preventing penetration of conventional rifle rounds. To prevent penetration of hand gun rounds, panel 31 has at least 40 and no more than 80 sheets of laminate structure 25. Adequate protection from extremely high powered rifles or rifles firing steel core and/or steel jacketed rounds may require up to 150 layers. Unbound laminate structures overlaid in substantial registration with each other and placed in pockets formed in garment 30 illustrates many types of garments that can incorporate panels as those disclosed.

Dragon Skin is a type of ballistic vest made by Pinnacle Armor. It is currently produced in Fresno, Calif. Its characteristic two-inch-wide circular discs overlap like scale armor, creating a flexible vest that allows a good range of motion and can allegedly absorb a high number of hits compared with other military body armor. The discs are composed of silicon carbide ceramic matrices and laminates, much like the larger ceramic plates in other types of bullet resistant vests. This armor has been known to withstand grenade blasts and up to 40 rounds of ammo.

Modern body armor systems incorporating two-dimensional flat ceramic plates are limited in stopping projectiles and preventing kinetic energy transfer to a wearer. Material composition used in armor is a primary concern. However, further application of principles of physics and engineering produced an innovative and effective design that overcomes the limitations of two-dimensional (2D) ceramic plate.

Initial Research

The U.S. Army Interceptor outer tactical vest (OTV) uses 28-30 layers of KEVLAR® ballistic fabric to currently protect its personnel against small arms fire and fragmentation. Front and back rigid armor inserts (small arms protective insert, SAPI) can be used to protect vital organs from high velocity armor piercing bullets. Rigid armor SAPI plates commonly comprise thick ceramic plate (0.8-1 inches), hardened steel, or high-strength titanium alloy. The plates cause bullets to fragment, while the underlying ballistic fabric catches the fragments of bullet and ceramic pieces.

In current war zones, service personnel traveling in convoys are frequently attacked by rocket propelled grenades (RPGs) and roadside improvised explosive devices (IEDs). When a RPG hits the side of an armored vehicle, the explosion creates four main types of threat: a) blast over-pressure (i.e., shock wave), b) blast superheated air and gases, c) shrapnel, fragments, and debris from the RPG's casing, and d) a spray of molten drops of liquid metal (spall) from the vehicle's steel.

As the ability of our offensive military technology expands, so too must our defensive capacity. Thus, a demand is increasing for body armor capable of withstanding high velocity armor-piercing rounds. Military engagements prove the demand for armor is critical in the survival of U.S. forces personnel. Also, high-powered weapons flood our cities causing an exponential increase in law enforcement officers that are outmatched and outgunned requiring a device to even the odds.

War leaves behind a legacy of wounded soldiers. For every fatality, between seven or eight are injured. From a financial standpoint, the cost of deploying one U.S. soldier for one year in Iraq reportedly is $390,000. Although the U.S. defense budget is half a trillion dollars, for many, the $260 per person for side armor remains too expensive. Our State Department says that most deaths are the result of inadequate body armor: Even though a few hundred dollars seems a nominal cost for protecting a life, the on-going debate of cost-effectiveness reveals the incredible need for effective, inexpensive armor like the current invention.

A Pentagon study found that at least 80% of marines killed in Iraq from wounds to their upper body could have survived if they had extra or improved body armor. The Department of Defense reports that as of May 28, 2010, there were 4,404 dead U.S. Armed Forces and 31,827 wounded in action in Iraq and, as of Jan. 13, 2011 between Iraq and Afghanistan, a total of 5,887 lives could have been saved with effective body armor. Even the body armor weight is enough to make soldiers seriously question leaving it off altogether. Service members deployed in Iraq and Afghanistan routinely carry loads from 60 to more than 100 pounds of equipment.

Much of the initial research for the invention, was spurred upon questioning the continual weaknesses and disadvantages in the battlefield of the Interceptor armor used in the military. When considering angular geometry in the mine resistant ambush protected (MRAP) Hum-V designed to minimize IED damage, the armor of the invention shares many of the same characteristics.

MRAP vehicles have "V" shaped hulls to deflect away any explosive forces originating below the vehicle thereby protecting the vehicle and its passenger compartment. U.S. military has already bought 10,000 MRAP vehicles proving their belief in the design, and even enhanced it with the MRAP II. But none have thought of applying its technology directly to any armor system such as protective body garments, protective shields, and panel construction for fitting enclosures including buildings, and vehicle and ship bodies with armored wall portions.

The level or grade of ballistic material depends on several testing factors; namely, type of weapon, caliber, bullet type, testing range, and projectile velocity. Kevlar® 29 fabrics are most often used in their dry form although they can be used in hard armor applications. Typical applications include: protective vests, gloves, hard armor helmets, and ballistic panels.

The material used in the invention is a high strength grade of steel as close to ballistics grade as possible that is typically far more cost-effective than an alternative such as Kevlar or ceramics. For steel is much more abundant to obtain and a practical resource to mass-produce. However, the mechanical design of the armor is found to be as important as its material composition. Most current research on armor delves solely into the composition aspect, i.e., the type material used to make the armor. The invention uses a mechanical engineering approach to better utilize what is already there through a more efficient mechanical design.

Problems Related to Body Armor

Several problems exist with body armor typically used today by law enforcement and military personnel. A primary issue that arises is cost. Most modern body armor front plates cost about $400 to $600, and entire armor suits sell for $1000 minimum, depending on its quality and projectile stopping capability. For example, a complete Interceptor body armor system currently used by the military costs $1500. Such a price is a direct result of the intricate ceramic composition of armor plates but can be partially avoided by using a cheaper material such as high-grade steel. Such steel is far more abundant and easy to use in design formation and production.

Most current body armor units can withstand a finite number of hits thus raising a large issue of sustainability. The armor is effectively useless because deep bullet penetration and a radial surface impact leaves most of a plate structurally unsound. Recent armor designs have a simple compactness with individual plates in a linear formation thus choosing material composition over physical design. More flexible materials such as Kevlar fail to stop high powered rounds.

Today's ceramic armor plate is intrinsically brittle and highly prone to stress fractures. If dropped, it has a high potential of cracking and suffering micro fractures that compromise the entire plate's integrity. Therefore, the armor plate must be X-rayed periodically to find any damage that may affect its performance. Most importantly, extremely high-energy transfer to a wearer occurs as the plate absorbs little of a bullet's energy so it does not effectively protect the wearer from energy damage.

PURPOSE OF THE INVENTION

The main purpose of this invention is to provide an armor system that is cost effective, maintains high performance characteristics, and eliminates current problems faced with modern armor systems.

Another object of the invention provides an armor system that includes a rigidly hard, non-flexible armor plate system capable of stopping multiple high velocity rounds and produces the least impact transfer of energy to a person wearing the armor.

A primary purpose of the invention is to provide a ballistic panel for preventing penetration of high-velocity projectiles and fragments through the panel from one side to the other.

Another purpose of the invention is to provide a ballistic panel for replacing any heavy flat armor on vehicles such as tanks, troop transports, airplanes, helicopters and the like to make them lighter and have more agile movement while gaining greater protection against shoulder fired rounds, IEDs, RPGs, hand grenades, and other explosive devices.

Another object of the invention provides an armor ballistic panel construction suitable for a variety of purposes such as for making protective body garments, shields, and enclosures including buildings, vehicles, and ships with armored wall structure portions.

A further object of the invention provides a ballistic panel design to better apply principles of physics to prevent penetration of high-velocity projectiles and fragments through the panel from one side to the other.

Another object of the invention provides an angular steel panel complex to induce directional change in an incoming high-velocity projectile thus minimizing its force vector by producing change in vector direction that will result from additional collisions to thereby reduce its magnitude in force, momentum, and thus energy.

A further object of the invention provides a protective armor panel that works in extreme cold and punishing heat so that it can be used all over the world in extreme climates.

A still further object of the invention is to provide an armor system that reduces the amount of radial surface area of projectile impact while still stopping its penetration through the armor to allow the armor to withstand multiple projectile hits and still have a protective function.

An object of the invention is to provide an armor system having a plurality of tubular plate layers, planar and curved, with laterally spaced layers that allows bending and oscillation of the plate material upon impact to increase the time for the projectile to stop its movement through the armor.

Another object of the invention is to provide a metal tubular armor system in which elongated tubes contain liquid to form hydrostatic armor.

An object of the present invention provides an angular armor design to cause striking projectiles to deform into an elliptical shape further increasing the surface area of a projectile's striking face and resulting in a shorter stopping distance for the projectiles.

Another object of the present invention provides an angular armor design to cause a deflection of a projectile's directional movement thereby increasing the surface area of the projectile thus reducing its penetrating ability.

A further object of the present invention provides an angular tubular armor design that strains a projectile's structural integrity causing them to split in half or into smaller fragments thereby greatly reducing its energy and its ability to penetrate the armor.

Another object of the present invention provides an angular tubular armor design having a plurality of forty-five degree angles to induce vector alteration of a striking ballistic projectile to create an optimized balance between the probability of projectile deflection and the effectiveness of the deflection.

Yet another object of the invention's angular armor design is using high pressure hydrostatics in titanium-steel alloy tubes joined by computer controlled welds for uniformity and precision.

A further object of the invention provides an armored body garment that weighs less than 10 pounds to reduce fatigue on arm muscles, and can be quickly removed in an emergency.

SUMMARY OF THE INVENTION

The invention is directed to an armor assembly having an angular, tubular structure for causing an incoming projectile to strike the tubular structure at a forty-five degree angle that induces vector alteration of the projectile upon impact and in its movement into the assembly to reduce its magnitude in force vector, momentum, and thus its kinetic energy. The assembly comprises at least two facing layers of parallel tubes, which have a rectangular cross-section and are composed of material having a high ballistic performance. The tubes are contiguously disposed at opposed outer diagonal tube corners with respect to each other to form crests and valleys on opposed outer sides of each layer of said tubular structure. The tubes of each layer are permanently fixed together at the valleys where the tubes are contiguously disposed with respect to each other. Each tube may be a) vertically disposed and extends from the top to the bottom of each layer in the assembly, or b) angularly disposed with respect to the vertical and extends from one side edge of the assembly to another side edge of each layer of the assembly.

Means for connecting the layers to join them together at outer edges of the assembly with facing outer sides of each layer being maintained laterally spaced with respect to each other. The valleys of a front layer are disposed over the crests of a back layer with the layers spaced an effective distance from each other by an amount sufficient whereby when a projectile strikes the front layer facing a shooter, the front layer oscillates and compresses toward the back layer. Consequently, the projectile's kinetic energy is transferred laterally, forced to make a ninety degree turn, and thereby follow a zig-zag path along the front layer parallel to the back layer before passing through said means for connecting said layers together to enter the back layer.

In a specific embodiment, each tube is vertically disposed and extends from the top to the bottom of each layer in the assembly. The means for connecting the layers together at their outer edges may include a resilient material that is disposed between the front and back layers of the assembly to insure spacing between layers forming the tubular structure, and to enhance the oscillation of the front layer upon impact of a projectile. The resilient material may include elastomeric spacers, such as rubber, placed between the layers to further inhibit the transfer of kinetic energy by creating a spring effect between the layers. The tubes are composed of metal and the tubes are welded together, and each tube has a square cross-section. In this embodiment, the material of the tubes may be a ballistic-grade, titanium steel alloy.

Another feature of the invention the tubes of the novel assemble includes low or high pressure hydrostatics to enhance the effectiveness of the stopping power of the armor assembly. Here each of the tubes of the armor is filled with a fluid, such as water, and each tube open end is closed with or without applying pressure to the fluid. The armor assembly of the invention may be selected from a group of armor assemblies comprising a body armor jacket; a personnel shield; and a wall portion of an enclosed structure such as a bunker or building; and ballistic panels for vehicles such as tanks, troop transports, aircraft, ships, and the like.

In another specific embodiment, an armor plate insert for a body armor jacket that includes an angular, tubular structure for causing an incoming projectile to strike the tubular structure at a forty-five degree angle that induces vector alteration of the projectile upon impact and in its movement into the assembly to reduce its magnitude in force vector, momentum, and thus its kinetic energy. The armor plate insert includes a shaped outer profile designed to protect a broad critical area of a wearer's front body portion, and at least two facing layers of parallel, rectangular tubes that are composed of material having a high ballistic performance. The tubes are contiguously disposed at opposed outer diagonal tube corners with respect to each other to form crests and valleys on opposed outer sides of each layer of the plate insert. The tubes of each layer are permanently fixed together at the valleys where the tubes are contiguously disposed with respect to each other.

Means for connecting the layers to join them together at outer edges of the insert with facing outer sides of each layer being maintained laterally spaced with respect to each other. The valleys of a front layer are disposed over the crests of a back layer with the layers spaced an effective distance from each other by an amount sufficient whereby when a projectile strikes the front layer facing a shooter, the front layer oscillates and compresses toward the back layer. Consequently, the shooter, the front layer oscillates and compresses toward the back layer. Consequently, the projectile's kinetic energy is transferred laterally, forced to make a ninety degree turn, and thereby follow a zig-zag path along the front layer parallel to the back layer before passing through the means for connecting the layers together to enter the back layer.

In a specific embodiment, each tube has a square cross-section, is vertically disposed, and extends from the top to the bottom of each layer in the armor plate insert. The means for connecting the layers together at their outer edges comprises a resilient material that is disposed between the front and back layers of the assembly to insure spacing between layers forming the armor plate insert, and to enhance the oscillation of the front layer upon impact of a projectile. The material of the tubes is composed of metal and the tubes are welded together. The tubes are composed of a ballistic-grade, titanium steel alloy, may each be filled with a fluid, and may have their open ends closed.

The structural design of the armor plate assembly assures that a projectile hitting anywhere on the strike face will penetrate the same amount of material regardless of its angle, direction, or location of impact. The angular structural design of the armor plate assembly thus has no weak spots. Welds running along both outer edges or sides of the plate assembly from top to bottom connect the front layer to the back layer. A resilient material may connect the front and back layers along the outer edges of the assembly; and may include elastomeric spacers disposed between the front and back layers of the assembly to further inhibit the transfer of kinetic energy by creating a spring effect; insure spacing between layers forming the armor plate; and enhance the oscillation of the front layer upon impact of a projectile.

A feature of my angular structural design is the forty-five degree angle in the armor that induces vector alteration of a striking ballistic projectile upon impact. A forty-five degree angle creates an optimized balance between probability of projectile deflection and effectiveness of the deflection. A projectiles's directional shift of movement created by this deflection induces yaw to thereby increase the surface area of the projectile that reduces its penetrating ability and stopping distance. A projectile's structural integrity is greatly strained so that it may split in half or into smaller fragments causing its energy and ability to penetrate the armor plate to be greatly reduced. A flat plate body armor design cannot effect such alteration to achieve this desired result.

The spaced tubular layers of the armor plate assembly allows a projectile to slow over a greater distance thus reducing the force of a bullet's kinetic energy according to an advanced compression and oscillation theory. The compression concept holds that a bullet's force causes the front tubular layer receiving its impact to effectively crumple it onto the next layer to significantly increase its time of movement and to reduce the amount of force delivered to a wearer.

The oscillation theory holds that a bullet's energy is forced all the way out to the outer edge of the tubular plate assembly where it passes from the front layer, facing the shooter, to the back layer via the welds or connections located at the outer edges of the assembly. One must imagine the energy rippling down to the edges of the armor assembly before moving to the next layer of the assembly thereby drastically spreading out the energy that cannot jump across the air space from one layer to the next.

For testing, modeling clay was used to simulate a human wearing the body armor of the invention. When a projectile struck the armor assembly during testing, a clay block placed behind the plate assembly showed that the energy dispersed and decentralized. For the armor only made a 0.5 mm indentation in the shape of the rectangular clay backing placed at the back face of an armor plate assembly being tested. When using a flat plate design, the clay showed highly focused kinetic energy transfer in the form of large and deep dents in the clay behind the place that the projectile struck.

Tests show that the angular structural armor design is significantly more effective at stopping various projectiles than current two (2) dimensional flat plate designs. In a side-by-side test of a flat mild grade steel plate and an angular mild grade steel plate of the invention, an increase in effectiveness of approximately 400% was observed. Unskilled craftsmen made the angular armor plate used in this test and is therefore subject to variations and defects. If made using computer controlled production equipment, the increase in effectiveness could be even more than 400%.

The hollow tubes may be completely filled with an incompressible fluid, such as water, and their open ends welded closed. An impacting projectile pressurizes the water when striking a tube of the armor assembly so the fluid greatly increases the armor's ability to resist projectile penetration. In a test of a tubular mild grade steel armor plate without containing fluid versus a low-pressure hydrostatic water in a tubular mild grade steel armor plate, an increase in effectiveness of about 84% was observed. This increase in effectiveness would be greater if the fluid inside the hydrostatic armor were at higher pressure. Hydrostatic pressure of fluid may be optimized within the tubes depending on the particular application of the armor plate assembly so as to perform at maximum efficiency without being over- or under-pressurized.

A specific embodiment of the invention relates to personnel body armor for protecting the human body from projectiles and from blast superheat, shrapnel, debris and molten metal spall from an explosive device. Level Four soft armor is infeasible because it easily transfers a dangerous amount of kinetic energy to the user including enough to cause deep lacerations, cracked ribs, crushed organs, and/or even death. Mild steel tubular layers of a plate assembly are rather heavy for use as body armor. However, an optimized titanium-steel alloy plate design would be substantially equivalent to the weight of ceramic plates currently used in body armor.

High and low pressure hydrostatics of liquids in the tubes, and computer controlled welds for uniformity and precision each contribute to more effective measures gained by applying my angular structural armor design to other protective structures such as hand-held shields; enclosures with armored wall structures for bunkers and buildings; and ballistic panels for vehicles, aircraft, and ships. The amount of material required to minimize weight without adversely effecting performance along with the length, width, wall thickness of the tubes, space between tube layers, and the material composition of the tubes, will depend on the particular application and the various projectiles against which personnel are to be protected.

BRIEF DESCRIPTION OF THE DRAWINGS

The accompanying drawings, which are incorporated in and form part of the specification, illustrate various features of the present invention and, together with the detailed description, serve to explain the principles of the invention that will be better understood from the following detailed description of a specific embodiment of the invention in conjunction with the drawings, in which.

DETAILED DESCRIPTION OF THE INVENTION

Figure 1:
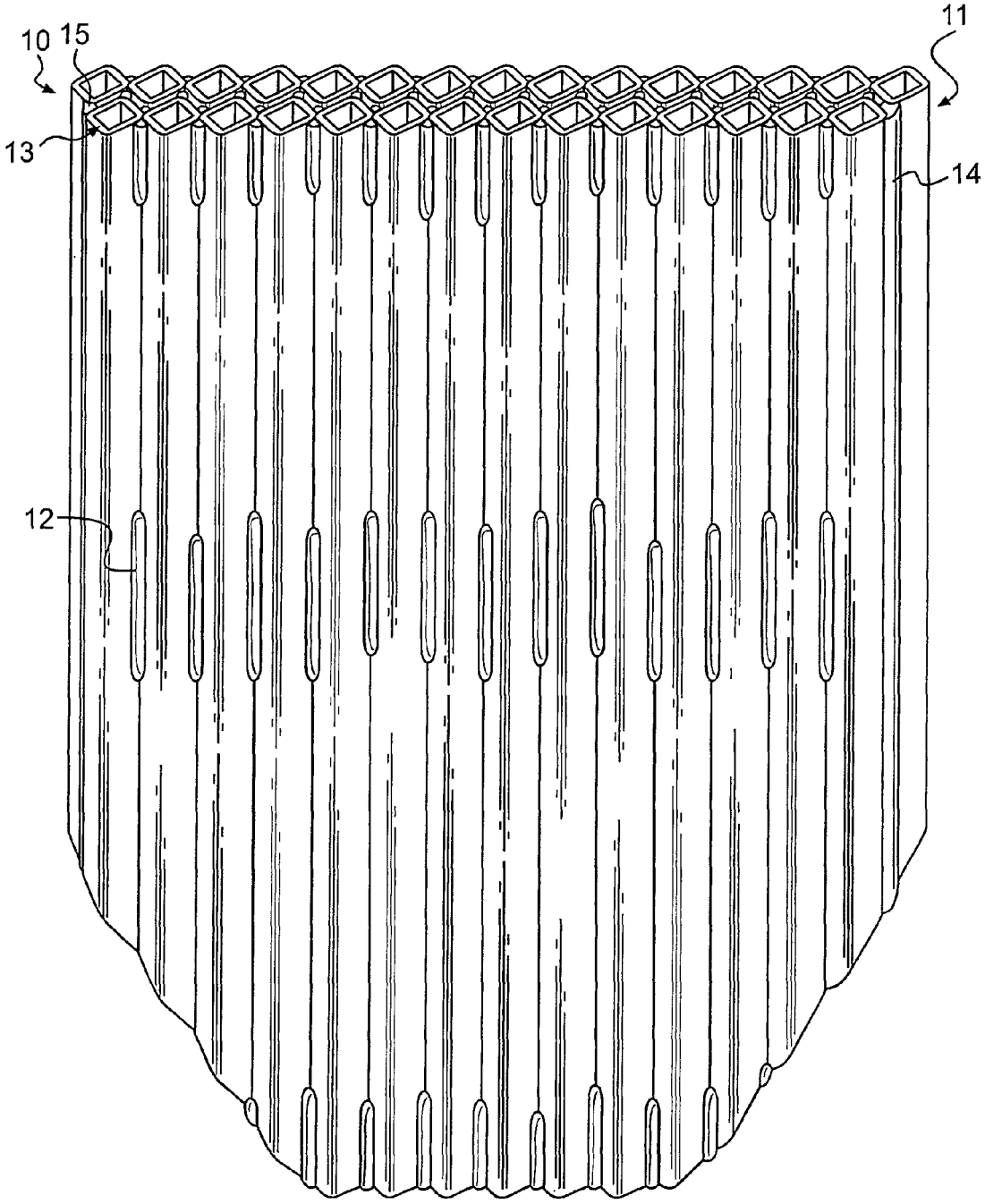
FIG. 1 is a bottom perspective view of a tubular armor plate assembly of a rigid multi-layered angular armor system of the present invention.

Referring to the drawings, a specific embodiment of the invention is directed to a body armor jacket or vest with a pocket for holding an insert made according to a multi-layered angular armor system. The insert has a shaped outer profile designed to protect a broad critical area of a wearer's front body portion and comprises an angular structural assembly 10 having a plurality of layers of parallel rectangular, contiguously disposed tubes that are welded at their contiguous diagonal corners. The tubes of assembly 10 induce directional change in movement of a striking projectile or bullet along its path into the assembly thereby redirecting its force vector. The sharper the change in the force vector, the lower is the magnitude of kinetic energy transfer to the wearer. That is, the change in vector direction caused by additional collisions with tube material will reduce its magnitude in force, momentum, and thus its kinetic energy.

Armor plate assembly 10 of this embodiment is metal and comprises at least two spaced rows or layers 11 and 13 of elongated square tubes that extend from the top to the bottom of assembly 10. The space between layers may be from about ⅛ inch up to about an inch, depending on the material being used in the tubes, their cross-sectional length, width, and wall thickness size. The space between layers used in hand-held shields; wall structures of or portions enclosures, such as bunkers or buildings; ballistic panels for vehicles such as tanks, troop transports, aircraft, ships, and the like may be up to about 4.0 inches, depending on the material being used in the tubes, their cross-sectional length, width, and wall thickness size.

Figure 2:
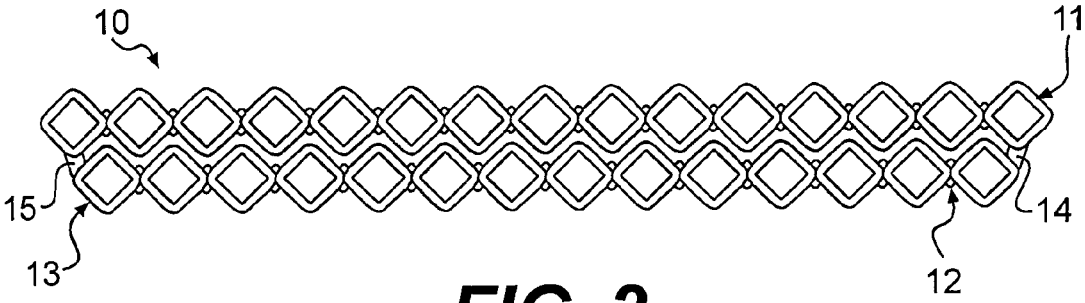
FIG. 2 is a bottom plan view of an embodiment of a welded tubular armor plate assembly of the multi-layered angular armor system of the invention.
Figure 3:
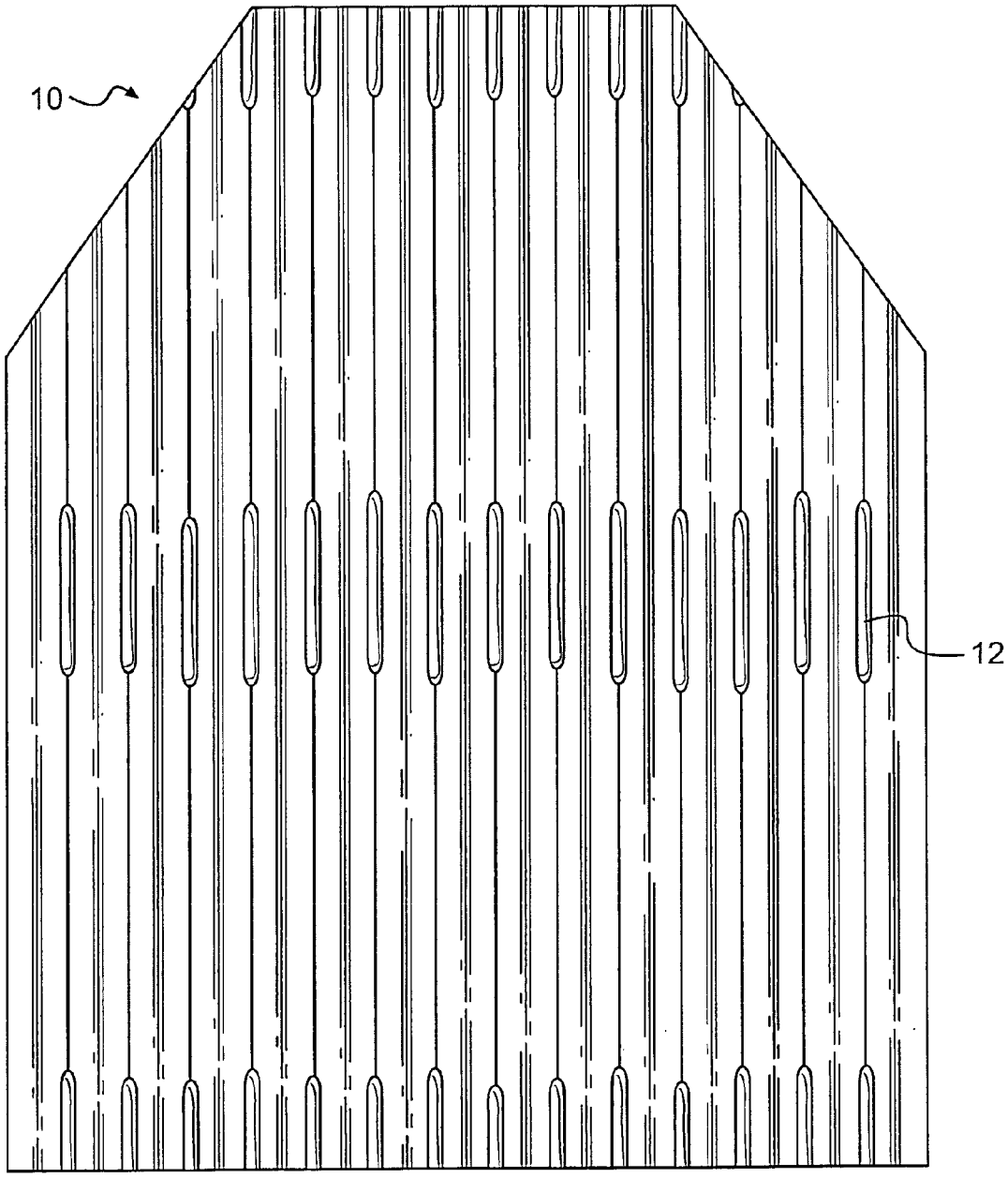
FIG. 3 is a front elevational view of the tubular armor plate assembly of the multi-layered angular armor system of the invention as shown in FIG. 1.

Welds 12 permanently fix or connect tubes to each other at their respective contiguous diagonal corners to form each row or layer 11 and 13 of parallel tubes. Welds 12 are shown only at top, bottom, and intermediate points along the valleys, but a computer controlled welding machine is contemplated to form a continuous weld in each valley from top to bottom of assembly 10. The two surfaces that face outwardly from each side of armor plate assembly 10 include crests and valleys formed when welds 12 join adjacent tubes at contiguous diagonal corners of the square tubes. As shown in FIGS. 1 and 2, welds 14 and 15 permanently fix or connect the end tubes of offset, laterally spaced layers 11 and 13 so that the valleys of back layer 11 are over crests of front layer 13 facing the potential shooter. Front layer 13 is spaced an effective distance from back layer 11 by an amount sufficient so that when a projectile or round strikes front layer 13 facing a shooter, the space between the front and back layers allows front layer 13 to oscillate and compress toward layer 11.

A tested specific embodiment comprises square 16-gauge tubes having a wall thickness of about 0.051 inch; outer dimensions being ½ inch×½ inch; and composed of a mild grade steel such as A500 Grade B. Use of a high strength or ballistic-grade alloy steel such as titanium-alloy steel, as close to ballistics-grade as possible, is contemplated for armor plate assembly 10. Outer dimensions of the disclosed embodiment of an armor plate assembly are 12 inches tall×9 inches wide×1 inch thick. Average body armor plate mass of the invention is 9.29 lbs (4.214 kg). Average body armor plate mass of the prior art is 9.37 lbs (4.250 kg). Steel is 41.82 pounds per square foot per inch of thickness (8039 kg/$m^3$.)

Figure 4:
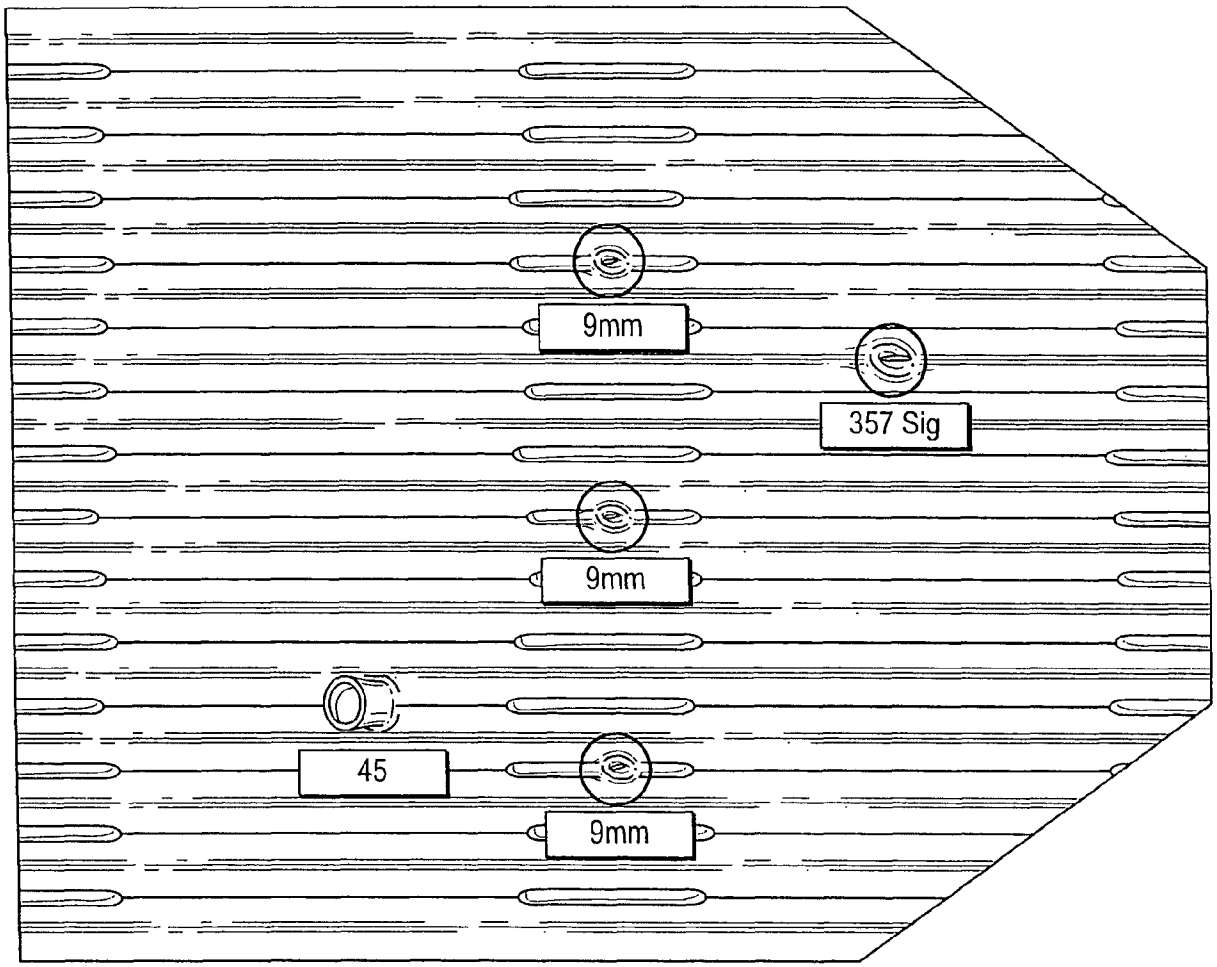
FIG. 4 is a photograph of a perspective view of a tubular armor plate assembly of the multi-layered angular armor system of the invention after impact by projectiles.

FIG. 4 shows the results of tests at spaced locations on a body armor plate by firing .45 ACP, 9 mm, and .357 SIG rounds from 30 yards away. A clay block placed behind the plate assembly collected data from the rounds striking the plates after every shot and showed that the energy of the projectile was dispersed, decentralized, and therefore did not indent the clay block. The difference in average indentation of armor plate between different rounds of fire was noticeable. The .357 SIG bullets produced greater indentations in the armor plate than the 9 mm bullets. Data gathered remained very consistent throughout all trials with 9 mm and .357 SIG bullets, none of which penetrated the armor plate. Point of impact is circled for each of the labeled rounds.

The impulse delivered the wearer of assembly 10 is a vital aspect of gunshot that can ultimately cause death of a soldier or law enforcement officer. In many cases, even if the bullet is completely stopped by current ceramic plate body armor, the monumental amount of impulse and kinetic energy transfer is enough to severely wound or even kill the wearer. Data gathered via the indentation on modeling clay backing an insert plate assembly during tests on armor plate of the invention shows that minuscule amounts of energy would have transferred to the wearer.

Figure 5:
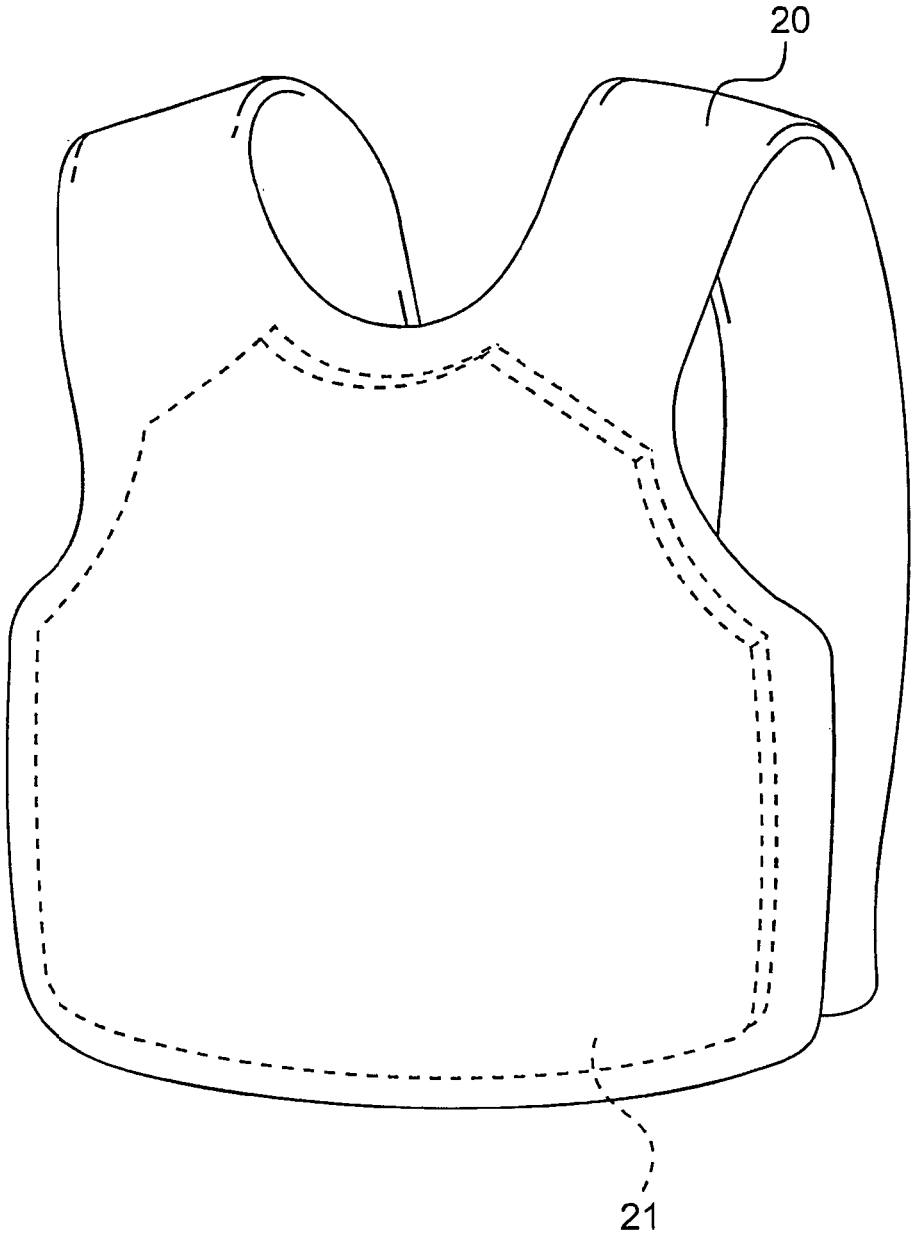
FIG. 5 is a perspective view of a body armor vest with pockets for holding inserts made according to the multi-layered angular armor system of the present invention.

FIG. 5 shows a body armor jacket 20 having a differently shaped armor plate assembly insert 21 designed to protect a broad body area on the wearer. Jacket 20, like all known armor jackets, includes a pocket designed to hold insert 21. The insert may include a curved configuration to more closely fit the body of a wearer. Its internal structural configuration will be like that of the specific embodiment disclosed and explained herein.

Benefits of Invention

Low cost, high performance, and amazing versatility of the armor plate system of the invention allow it to be modified and applied as an armor system for things such as vehicles, aircraft, fortified areas, and enclosures. It can easily be modified to match performance levels of current armor systems while weighing far less than those known systems. Modifications include, but are not limited to, use of a different rectangular shapes including square cross-sections made with differing gauge metal in the tubes; larger or smaller outer dimensions of the square tubing depending on the particular application; a greater number of tubes welded together to protect a larger area such as upright shields; a greater number of tubular layers to obtain a larger distance for a projectile to travel for precluding projectile penetration into an enclosure and the like.

The invention allows the armor field to learn key concepts in mechanical engineering, ballistics, and advances in armor technology that particularly transcend linear two-dimensional plate body armor designs with respect to three-dimensional, more structurally complex mechanisms. The body armor of the invention will help protect our troops in combat as well as police officers that risk there life to keep our society safe. The armor system of the invention incorporates an idea that protects people against bullets, fragments, explosives, and any high velocity projectile thus saving lives in general.

Finally, the results from ballistic strikes will yield marginal variance within naturally occurring temperatures, as opposed to other prior art armor systems such as Dragon Skin. Therefore, the armor plate assembly of the invention could be used all over the world in extreme climates, be it Russian winter cold or Afghan desert heat.

While the armor assembly has been shown and described in detail, it is obvious that this invention is not to be considered as limited to the exact form disclosed, and that changes in detail and construction may be made therein within the scope of the invention without departing from the spirit thereof.

I claim:

1. An armor assembly having an angular, tubular structure for causing an incoming projectile to strike the tubular structure at a forty-five degree angle that induces vector alteration of the projectile upon impact and in its movement into the assembly to reduce its magnitude in force vector, momentum, and thus its kinetic energy, said assembly comprising:

a) at least two facing layers of parallel tubes, which have a rectangular cross-section and are composed of material having a high ballistic performance;

b) said tubes being contiguously disposed at opposed outer diagonal tube corners with respect to each other to form crests and valleys on opposed outer sides of each layer of said tubular structure;

c) said tubes of each layer are permanently fixed together at the valleys where the tubes are contiguously disposed with respect to each other;

d) means for connecting said layers to join them together at outer edges of the assembly with facing outer sides of each layer being maintained laterally spaced with respect to each other; and e) the valleys of a front layer being disposed over the crests of a back layer with the layers spaced an effective distance from each other by an amount sufficient whereby when a projectile strikes the front layer facing a shooter, the front layer oscillates and compresses toward the back layer so that its kinetic energy transfers laterally when forced to make a ninety degree turn, and to follow a zig-zag path along the front layer parallel to the back layer before passing through the means for connecting the layers to enter the back layer.

2. An armor assembly as defined in claim 1, wherein each tube is vertically disposed and extends from the top to the bottom of each layer in the assembly.

3. An armor assembly as defined in claim 2, wherein said is a wall structure of an enclosure.

4. An armor assembly as defined in claim 2, wherein said armor assembly is a hand-held shield.

5. An armor assembly as defined in claim 2, wherein said means for connecting said layers together at their outer edges comprises a resilient material that is disposed between the front and back layers of the assembly to insure spacing between layers forming the tubular structure, and to enhance the oscillation of the front layer upon impact of a projectile.

6. An armor assembly as defined in claim 5, wherein said resilient material includes elastomeric spacers placed between the layers to further inhibit the transfer of kinetic energy by creating a spring effect.

7. An armor assembly as defined in claim 1, wherein each tube is angularly disposed with respect to the vertical and extends from one side edge of the assembly to another side edge of each layer of the assembly.

8. An armor assembly as defined in claim 1, wherein the tubes are composed of metal and the tubes are welded together.

9. An armor assembly as defined in claim 8, wherein each tube has a square cross-section.

10. An armor assembly as defined in claim 8, wherein the material of the tubes is a ballistic-grade, titanium steel alloy.

11. An armor assembly as defined in claim 1, wherein each of the tubes is filled with a fluid and each tube open end is closed.

12. An armor assembly as defined in claim 11, wherein the fluid is water.

13. An armor assembly as defined in claim 11, wherein the fluid is pressurized.

14. An armor assembly as defined in claim 1, wherein said armor assembly is selected from a group of armor assemblies comprising a body armor jacket; a personnel shield; and a wall portion of an enclosed structure such as a bunker or building; and ballistic panels for vehicles such as tanks, troop transports, aircraft, ships, and the like.

15. An armor plate insert for a body armor jacket, said plate having an angular, tubular structure for causing an incoming projectile to strike the tubular structure at a forty-five degree angle that induces vector alteration of the projectile upon impact and in its movement into the assembly to reduce its magnitude in force vector, momentum, and thus its kinetic energy, said armor plate comprising:

a) a shaped outer profile of said plate designed to protect a broad critical area of a wearer's front body portion, and at least two facing layers of parallel, rectangular tubes that are composed of material having a high ballistic performance;

b) said tubes being contiguously disposed at opposed outer diagonal tube corners with respect to each other to form crests and valleys on opposed outer sides of each layer of said plate insert;

c) said tubes of each layer are permanently fixed together at the valleys where the tubes are contiguously disposed with respect to each other;

d) means for connecting said layers to join them together at outer edges of the insert with facing outer sides of each layer being maintained laterally spaced with respect to each other; and e) the valleys of a front layer being disposed over the crests of a back layer with the layers spaced an effective distance from each other by an amount sufficient whereby when a projectile strikes the front layer facing a shooter, the front layer oscillates and compresses toward the back layer so that the projectile's kinetic energy is transferred laterally, forced to make a ninety degree turn, and thereby follow a zig-zag path along the front layer parallel to the back layer before passing through said means for connecting said layers together to enter the back layer.

16. An armor plate insert as defined in claim 15, wherein each tube has a square cross-section, is vertically disposed, and extends from the top to the bottom of each layer in the armor plate insert.

17. An armor plate insert as defined in claim 16, wherein said means for connecting said layers together at their outer edges comprises a resilient material that is disposed between the front and back layers of the assembly to insure spacing between layers forming the armor plate insert, and to enhance the oscillation of the front layer upon impact of a projectile.

18. An armor plate insert as defined in claim 15, wherein the material of the tubes is composed of metal and the tubes are welded together.

19. An armor plate insert as defined in claim 18, wherein the tubes are composed of a ballistic-grade, titanium steel alloy.

20. An armor plate insert as defined in claim 15, wherein each of the tubes is filled with a fluid and each tube open end is closed.

* * * * *